US011268269B2

(12) United States Patent
Stammel et al.

(10) Patent No.: US 11,268,269 B2
(45) Date of Patent: Mar. 8, 2022

(54) SANITARY INSTALLATION

(71) Applicant: Duravit Aktiengesellschaft, Hornberg (DE)

(72) Inventors: Thomas Stammel, Hornberg (DE); Thomas Konstanzer, Offenburg (DE); Ulrich Weber, Haslach (DE)

(73) Assignee: DURAVIT AKTIENGESELLSCHAFT, Hornberg (DE)

( * ) Notice: Subject to any disclaimer, the term of this patent is extended or adjusted under 35 U.S.C. 154(b) by 0 days.

(21) Appl. No.: 16/884,490

(22) Filed: May 27, 2020

(65) Prior Publication Data

US 2020/0378100 A1 Dec. 3, 2020

(30) Foreign Application Priority Data

May 28, 2019 (DE) ..... 10 2019 114 279.2

(51) Int. Cl.
*E03C 1/322* (2006.01)
*E03C 1/182* (2006.01)

(52) U.S. Cl.
CPC ..... *E03C 1/322* (2013.01); *E03C 1/182* (2013.01)

(58) Field of Classification Search
CPC ..... E03C 1/322
USPC ..... 4/630, 619, 517, 546, 597, 625, 631
See application file for complete search history.

(56) References Cited

U.S. PATENT DOCUMENTS 9,516,976 B2 * 12/2016 Stammel ..... B32B 38/0004
2015/0201812 A1 * 7/2015 Stammel ..... B32B 37/12 4/643
2018/0251964 A1 * 9/2018 Chung ..... A47K 10/48
2019/0309504 A1 * 10/2019 Yoshizawa ..... A47K 1/04
2019/0323216 A1 * 10/2019 Yoshizawa ..... E03C 1/14
2020/0199858 A1 * 6/2020 Eilmus ..... E03C 1/18
2020/0256044 A1 * 8/2020 Kim ..... A47B 88/40
2021/0015307 A1 * 1/2021 Oberholzer ..... A47K 1/04
2021/0071403 A1 * 3/2021 Diethelm ..... E03C 1/322
(Continued)

FOREIGN PATENT DOCUMENTS

CN 201958714 U 9/2011
CN 104790469 A 7/2015
CN 208693108 U 4/2019
(Continued)

OTHER PUBLICATIONS

Indian Patent Office issued an Office Action dated Mar. 18, 2021 regarding parallel Indian Patent Application No. 202014019092, 6 pages.

(Continued)

*Primary Examiner* — Lori L Baker

(74) *Attorney, Agent, or Firm* — Lucas & Mercanti, LLP; Klaus P. Stoffel

(57) ABSTRACT

A sanitary installation, including a ceramic or porcelain wash basin or wash stand and a vanity unit, wherein the vanity unit has at least one pull-out drawer having two side walls and a front wall, wherein the shape of the side walls and of the front wall conforms to the shape of the front and side end faces of the wash basin or wash stand, wherein the end faces are aligned with the side walls and the front wall, and wherein the side walls, the front wall and the end faces are coated with a veneer, applied via an adhesive bond, or with a paint.

12 Claims, 6 Drawing Sheets

(56) References Cited

U.S. PATENT DOCUMENTS

2021/0189706 A1* 6/2021 Salviato ..... E03C 1/14

FOREIGN PATENT DOCUMENTS

| | | | |
|---|---|---|---|
| DE | 9011981 | U1 | 10/1990 |
| GB | 2536616 | A | 9/2016 |
| JP | 2006055543 | A | 3/2006 |
| RU | 174374 | U1 | 10/2017 |

OTHER PUBLICATIONS

Webarchiv, Snapshot vom Mar. 10, 2017, https://web.archive.org/web/20171003191857/https://www.duravit.de/produkte/alle_serien/happy_d2.de-de.html?product=3383379 [abgerufen am Jun. 6, 2020].
Duravit, Hornberg, URL: https://www.duravit.de/produkte/a11e_serien/happy_d2.de-de.html?product=3383379 Happy 0.2 Waschtischunterbau—Pflegeanleitung [abgerufen am May 3, 2020].
Duravit, Hornberg, URL: https://www.duravit.de/produkte/al1e_serien/happy_d2.de-de.html?product=3383379 Happy D.2 Waschtischunterbau—Montageanleutung 2018 [abgerufen am May 3, 2020].
German Examination Report dated Mar. 6, 2020 issued in DE 10 2019 114 279.2, 5 pages.
Chinese Patent Office issued Office Action dated Oct. 11, 2021 regarding parallel Chinese Patent Application No. 202010408761.6, 4 pages.
https://m.weibo.cn/2865360250/4264280679599568, 3 pages.
Canadian Intellectual Property Office (CIPO) issued an Office Action dated Jun. 23, 2021 regarding the parallel Canadian Patent Application No. 3,080,776, 4 pages.
The Bath Outlet, "24 Inch Vanity Cabinet with Fitted Sink", https://web.archive.org/web/2020*/https://www.thebathoutlet.com/bathroom-vanity-24-inch-vanity-cabinet-with-fitted-sink-acf-da04/product/1270, Jul. 15, 2017 (Jul. 15, 2017), 8 pages.
Mitre 10 New Zealand, "How to Install a Wall Hung Vanity", https://www.youtube.com/watch?v=AWFtNaEyfCk, Aug. 6, 2018 (Aug. 6, 2018), 1 page.
Duravit, "L-Cube Vanity Unit Wall-Mounted", https://web.archive.org/web/2020*/https://www.duravit.us/products/all_series/l-cube.us-en.html?product=2150081, Apr. 9, 2016 (Apr. 9, 2016), 7 pages.

* cited by examiner

SANITARY INSTALLATION

CROSS-REFERENCE TO RELATED APPLICATIONS

The present application claims priority of DE 10 2019 114 279.2, filed May 28, 2019, the priority of this application is hereby claimed and this application is incorporated herein by reference.

BACKGROUND OF THE INVENTION

The invention relates to a sanitary installation, comprising a ceramic or porcelain wash basin or wash stand and a vanity unit.

A wash basin or a wash stand is often arranged on a vanity unit (see in this connection, for instance, DE 90 11 981 U), which supports the wash stand and offers the possibility of storing articles therein. Such a vanity unit is usually constructed as a cabinet. Such a vanity unit often looks relatively clunky, the design as a cabinet with corresponding doors is sometimes awkward to use, since the vanity unit is located beneath the wash basin or wash stand, so that access is possible only from the front.

SUMMARY OF THE INVENTION

The problem underlying the invention is hence to define a superior, attractive and, in terms of convenience of use, improved sanitary installation.

In order to solve this problem, in a sanitary installation of the type stated in the introduction it is provided that the vanity unit has at least one pull-out drawer having two side walls and a front wall, wherein the shape of the side walls and of the front wall conforms to the shape of the front and side end faces of the wash basin or wash stand, wherein the end faces are aligned with the side walls and the front wall, and wherein the side walls, the front wall and the end faces are coated with a veneer applied via an adhesive bond, or with a paint.

The sanitary installation according to the invention is distinguished by an attractive, compact structure offering improved accessibility to the inside of the vanity unit. The sanitary installation has first of all, in the vanity unit, at least one drawer, which can be pulled out to the fore when the person is standing in front of the wash basin or wash stand. This drawer enables access from above, which makes the insertion and removal of articles substantially easier.

In addition, the sanitary installation according to the invention is distinguished by an appealing, compact shape, since all front and side faces of the vanity unit and of the wash basin or wash stand are mutually aligned. That is to say that the front wall and the side walls of the drawer, and hence the drawer shape, conform to the shape of the front and side end faces of the wash basin or wash stand, and hence to the shape of the wash basin or wash stand. That is to say that the shape of the wash basin or wash stand continues virtually right across the drawer, so that a compact, with closed drawer, also closed external appearance is given.

In addition, all faces, i.e. the drawer-side side walls and the front wall, as well as the side and front end faces of the wash basin, are respectively provided with a glued-on veneer. Since the corresponding faces of the wash basin or wash stand and of the vanity unit or drawer are mutually aligned, also the applied veneers are consequently aligned, which is particularly beneficial to the visual appearance. That is to say that, in the sanitary installation according to the invention, elements having the same geometry, namely wash basin or wash stand and vanity unit or drawer, with mutually aligned wall surfaces and aligned veneer surfaces, are used. This produces a structure which is virtually closed in terms of the external shape, while, at the same time, very good convenience of use is given, due to the integration of the at least one drawer.

Particularly advantageously, beneath the drawer is provided at least one further drawer, the side walls and front wall of which is coated with a veneer or a paint and are aligned with the side walls and the front wall of the above-situated drawer. According to this embodiment of the invention, a plurality of drawers are thus provided on the vanity unit, all of which have the same geometry or surface shape. Preferredly, two drawers are provided, an upper drawer, which is arranged directly beneath the wash basin or wash stand, and a second drawer, which is located beneath the first drawer and which then extends to close to the floor. In this case, the geometry of the vanity unit is defined by both drawers or all drawer wall surfaces, further structural elements of the vanity unit being in this case no more visible. If only one drawer is used, then beneath this drawer can be provided an immovable part of the vanity unit, having a front wall and two side walls, which then, however, in turn conform to the geometry of the above-situated drawer and are aligned with the corresponding wall surfaces, so that, with closed drawer, a completely closed total body is once again obtained.

The transition of the end faces one to another, or of the side walls to the front wall, can be different in nature. It is conceivable that the end faces one to another, and the side walls and the front wall one to another, run at an angle of 90° one to another, and mitered, for instance, butt one against another. Alternatively, it is also conceivable that the end faces, as well as the side walls and the front wall, merge into another via a curvature, that is to say that curvatures having an appropriate radius are realized in the edge region or transition region. Even a complete curvature, which defines the geometry of the wash basin or wash stand and of the one or more drawers and extends from one side to the other side, hence virtually a 180° semicircle, would be conceivable. In this case, the sanitary installation would virtually have a semispherical shape.

As described above, according to one alternative of the invention, the lateral and the front end face of the wash stand, as well as the front and side walls of the one or more drawers, are coated with a veneer. The sanitary installation according to the invention is thus clad on all sides with a veneer, which frames both the vanity unit and the wash basin or the wash stand. Because the veneer is bonded, a correspondingly seal-tight transition or a seal-tight covering is consequently also obtained, so that no water can penetrate behind the veneer, which in particular is expedient with regard to the vanity unit, generally built of wood or woody materials. It is herein of advantage if the corresponding faces of the wash basin or wash stand, here in the form of a ceramic or porcelain structural element produced in a firing process, are machined as flat as possible, hence are therefore as flat as possible, in order that the veneer can likewise be flatly applied. Alternatively, the surfaces can also be coated with a paint which likewise correspondingly closes the surfaces, so that no water can penetrate into the vanity unit.

It is here expedient if the veneer provided on the wash basin or wash stand extends up to the right-angled top edge of the wash basin or wash stand, that is to say that the veneer terminates flush with this top edge. The adhesive bond here ensures a seal-tight joint, which prevents any penetration of water into this region.

As the adhesive, an epoxy resin adhesive or polyurethane (PU) adhesive is preferably used, which, on the one hand, enables a firm and seal-tight connection of the veneer to the ceramic or porcelain body, yet, on the other hand, also to the vanity unit or to the surfaces which are exposed there and are to be veneered.

As the veneer, a real wood veneer, a decorative veneer or a laminated veneer can be used, for instance, wherein ultimately no limits are given by the choice of material. This means that also a very large range of colors and patterns of the usable veneer, which defines the lateral visible surface of the sanitary installation, is hence given.

As the paint, which can naturally have any chosen color, a polyurethane (PU) paint or a water-based paint, i.e. a water-soluble paint, can, for example, be used.

in a refinement of the invention, the vanity unit itself has a supporting structure provided beneath the wash basin or wash stand, which supporting structure is fixed on the bottom side of the wash basin or wash stand and/or, in the assembly position, is fixed to the wall and has linear runners on which the one or both drawers run. Expediently, this supporting structure is wall-mounted, wherein the wash basin or wash stand sits on the supporting structure, fixed to the latter. The supporting structure is fixed to the wall via suitable bolted joints. Via appropriate bolted joints, the wash basin or wash stand is itself fastened on the supporting structure, for which purpose appropriate interfaces are provided both on the supporting structure and on the wash basin or wash stand. A fastening of the wash basin or wash stand to the wall consequently does not take place.

The supporting structure, which, on the one hand, serves to receive and support the wash basin or wash stand, additionally, however, also serves to receive the linear runners, via which the drawers are mounted in pull-out arrangement. For this purpose, the supporting structure preferably has a number of horizontally arranged supports corresponding to the number of drawers, on which supports the linear runners, via which the drawers are mounted in pull-out arrangement on the supports, are disposed. The supports can be provided in the form of supporting arms or supporting plates and serve for the mounting and support of the drawer. They are fixedly anchored in or to the supporting structure in order to also be able to securely support a drawer which has been pulled out far.

The linear runners are preferably realized as undermount runners, that is to say they sit beneath the drawer bottom or bottoms and not at the side. They are consequently concealed and, in the closed state, are not visible or viewable from the side, so that these linear runners do not disturb the appealing visual appearance of the sanitary installation.

The design of the sanitary installation can be such that the surfaces of the drawer arranged beneath the wash basin or wash stand are distanced only with minimal gap from the aligned surfaces of the wash basin or wash stand. Insofar as a second drawer is provided, its surfaces too are distanced only by a minimal gap from the aligned surfaces of the above-situated drawer. This gap can lie within the range of, for instance, 1-5 mm. Alternatively thereto, appropriate, somewhat stronger joints can also be formed, that is to say that the corresponding surfaces between wash basin or wash stand and drawer, or between drawer and drawer, are distanced from one another, for instance, by a groove of, for example, 1-3 cm. By this means, the look of the sanitary installation can be lent a further individual component. This can be further reinforced by the fact that the supporting structure can be geometrically constructed in such a way that it virtually forms the respective groove bottom, that is to say that the supporting structure, with closed drawers, is visible as a groove bottom or gap bottom. There is now the possibility of covering the supporting structure itself, in this region, with the same veneer or paint, or to design it in a different color, so that an appropriately visually offset effect is obtained. It is also conceivable to lay on the supporting structure, that virtually forms the groove bottom, a lighting strip, which can be switched on and virtually illuminates the groove, which is likewise beneficial to the visual appearance.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
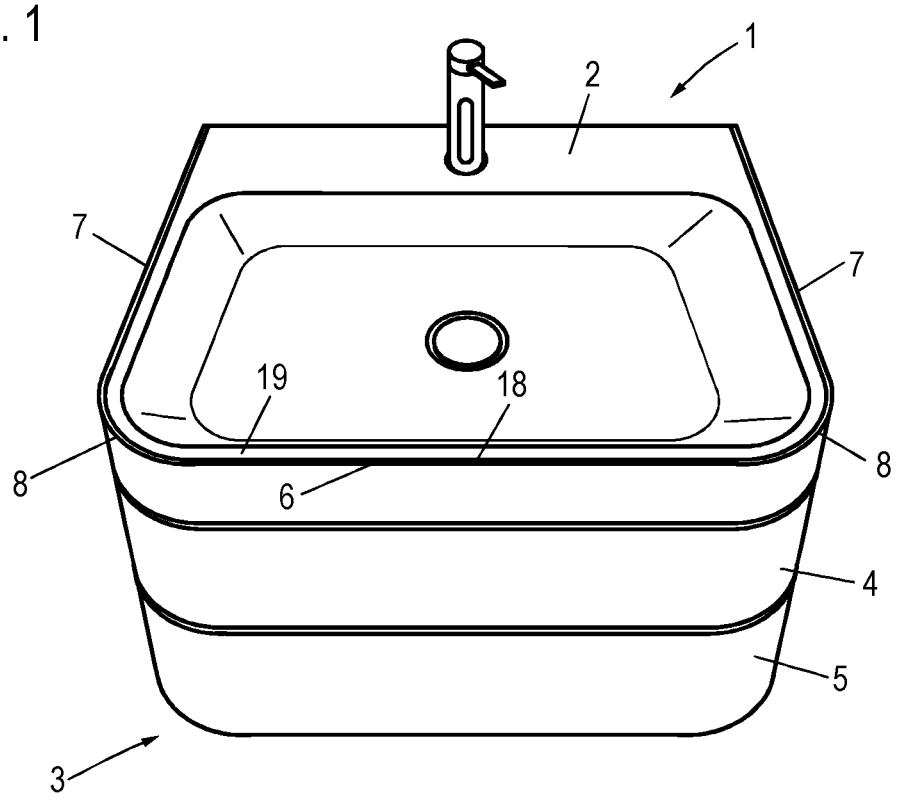
FIG. 1 shows a perspective front view of a sanitary installation according to the invention.

FIG. 1 shows a sanitary installation 1 according to the invention, here comprising a ceramic or porcelain wash basin 2, and a vanity unit 3, which (see the views according to FIGS. 2-5) has two separately maneuverable pull-out drawers 4, 5. As is shown in particular by FIGS. 2-5, the vanity unit 3 does not extend down to the floor, it ends freely suspended above the floor. However, it can extend as far as the floor if so desired.

The wash basin 2 has a front end face 6 and two lateral end faces 7, wherein the lateral end faces 7 merge into the front end face 6 via curvatures 8.

Correspondingly, in line with the geometry of the surfaces of the wash basin 2, each drawer 4, 5 has a front wall 9, 10 and side walls 11, 12, which likewise merge into one another via appropriate curvatures 13, 14. All end faces 6, 7, and the front and side walls 9, 10, 11, 12, as well as the curvatures 8, 13, are mutually aligned, thus, in vertical view, merge seamlessly one into another. To this end, the wash basin 2 is preferably ground flat on the front and the lateral end faces 6, 7 and machined appropriately on the curvatures 8, so that appropriate plane surfaces are obtained.

All end faces 6, 7, as well as all front and side walls 9-12, are coated with a veneer 15, 16, 17, which consequently covers the whole of the surfaces of the wash basin 2 as well as of each drawer 4, 5. The veneers 15, 16, 17 are fastened to the wash basin 2 and to the drawers 4, 5 via an appropriate adhesive bond, for which preferably an epoxy resin or polyurethane adhesive is used. The veneers 15, 16, 17 can be in the form of a real wood veneer or a decorative veneer or the like.

The veneer 15 which covers the wash basin 2 extends up to the virtually right-angled, circumferential front edge 18 thereof, see FIG. 1. It consequently thus terminates flush with the surface 19 of the wash basin 2. Due to the bonding, a seal-tight joint is obtained in this transition region, an ingress of water is prevented. The right-angled edge 18 is able, in particular, to be very easily formed by virtue of the fact that the corresponding front and lateral end faces 6, 7 are ground flat.

Figure 2:
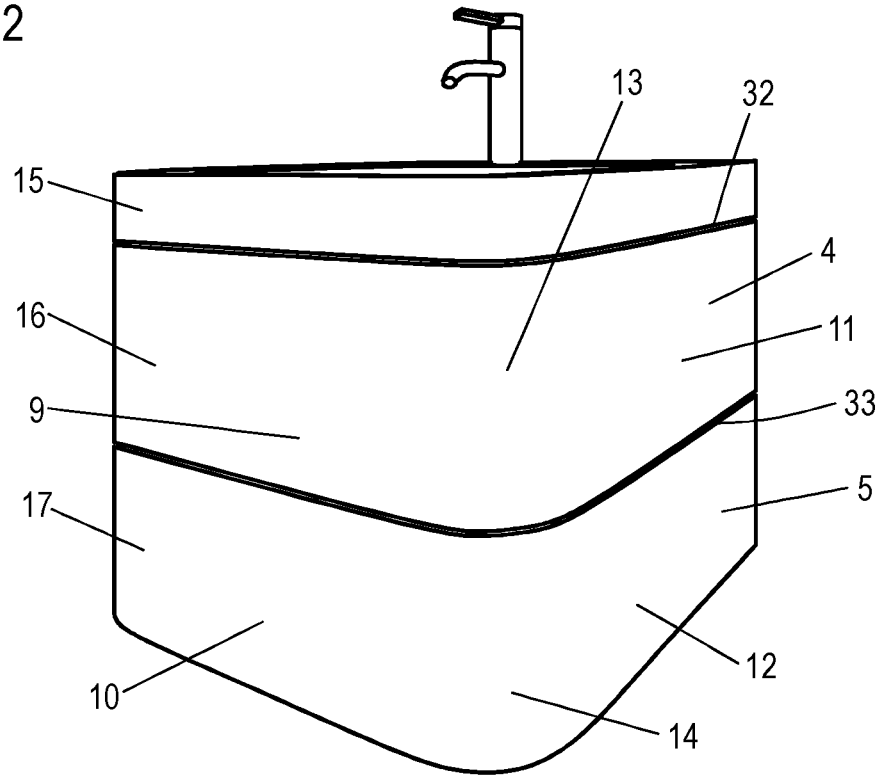
FIG. 2 shows a perspective side view of the sanitary installation from FIG. 1.
Figure 3:
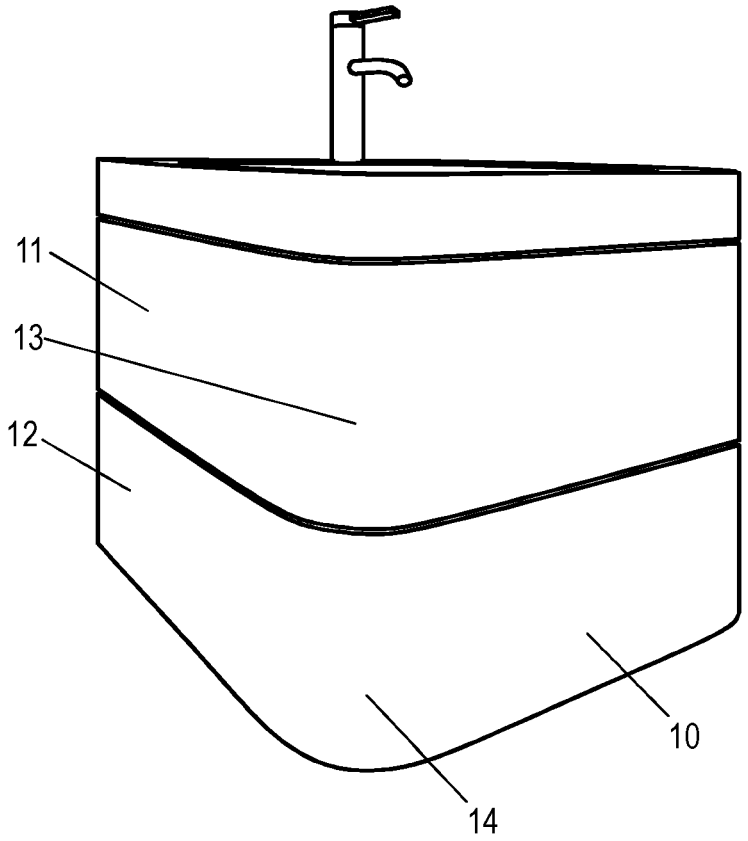
FIG. 3 shows a perspective side view from the other side.

As is shown in particular by FIGS. 2 and 3, due to the geometrical consistency and the fact that the drawers 4, 5 alone define the front and lateral exterior of the vanity unit 3 (other parts of the vanity unit 3 are not visible), a very appealing, compact exterior is obtained, wherein the two drawers 4, 5 offer the possibility of convenience of use or an easily accessible storage facility.

At this point, it should be indicated that, instead of the rounded embodiment in the region of the wall transitions or surface transitions, respectively an angular wall transition having for instance, mitered wall elements alongside the drawers 4, 5, or end faces of the wash basin 2 which are ground at a 90° angle, is also conceivable. In this case too, appropriate veneering via the adhesive bond is readily possible. Furthermore, there is the possibility of, in place of the veneers, coating the corresponding surfaces with a paint, i.e. offering a virtually free choice of color, for example with a PU paint or a water-soluble paint.

Figure 4:
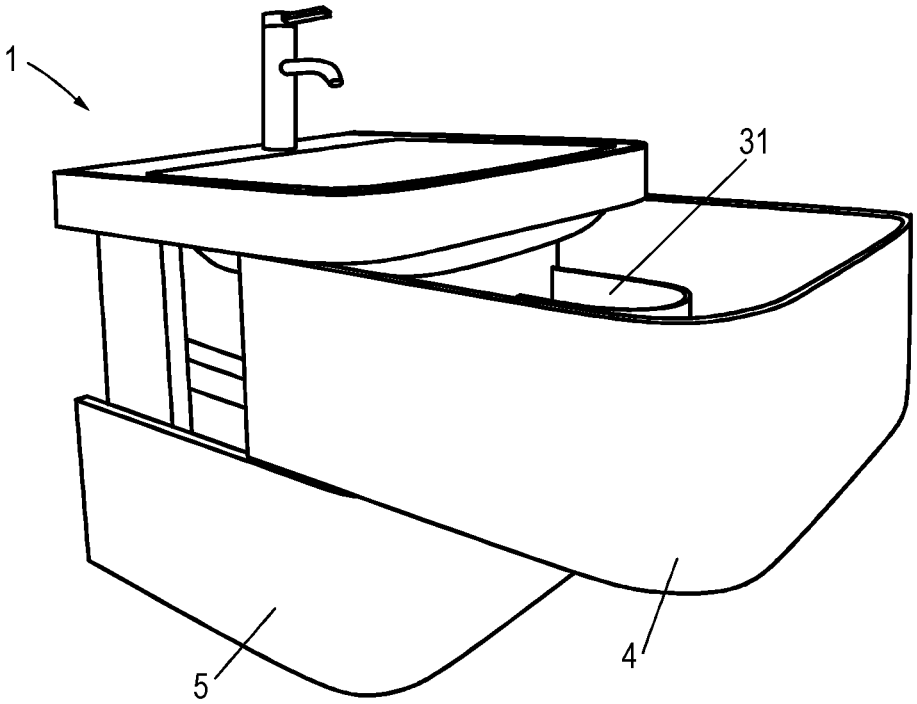
FIG. 4 shows a perspective side view of the sanitary installation from FIG. 1 with pulled-out top drawer.
Figure 5:
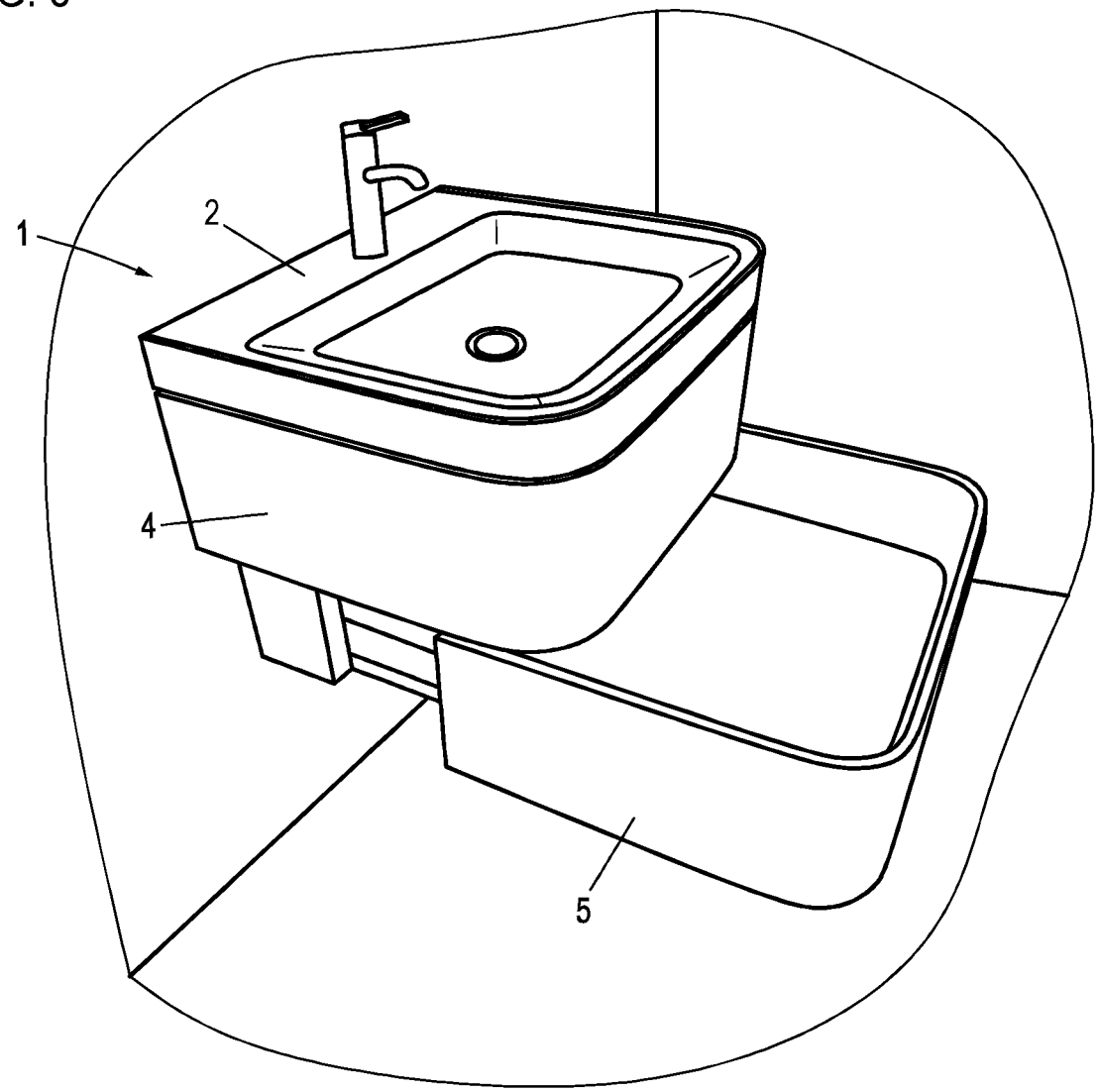
FIG. 5 shows a corresponding view with pulled-out lower drawer.

FIGS. 4 and 5 show two perspective views of the sanitary installation 1, wherein FIG. 4 shows the situation in which the drawer 4, i.e. the upper drawer, is pulled out to the fore, while the lower drawer 5 is closed. Evidently the inside of the drawer 4 can be readily viewed from above, wherein an unhindered easy access without having to kneel, for instance, as would be the case with a bottom part of a cabinet, is conceivable.

FIG. 5 shows the sanitary installation 1, wherein the upper drawer 4 is here closed and the lower drawer 5 is pulled out. Once again, the easy access is apparent.

Figure 6:
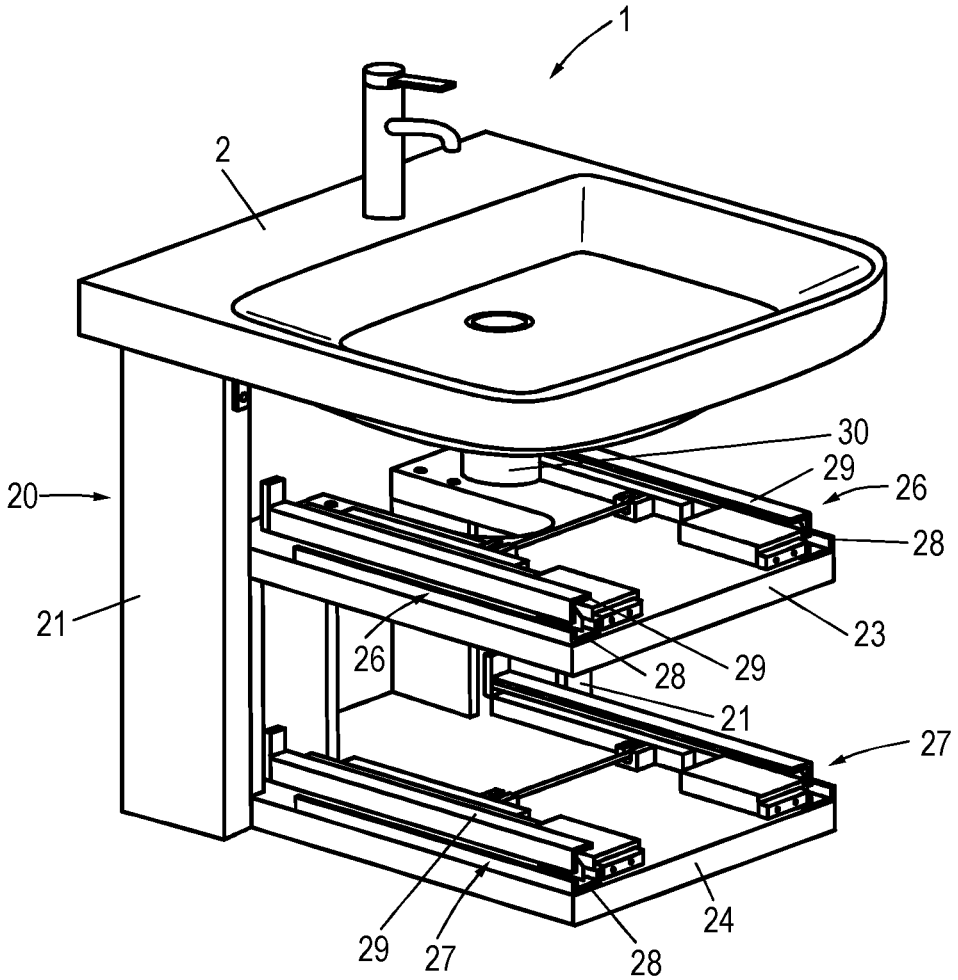
FIG. 6 shows a basic representation of a sanitary installation according to the invention without drawers, for representation of the supporting structure.
Figure 7:
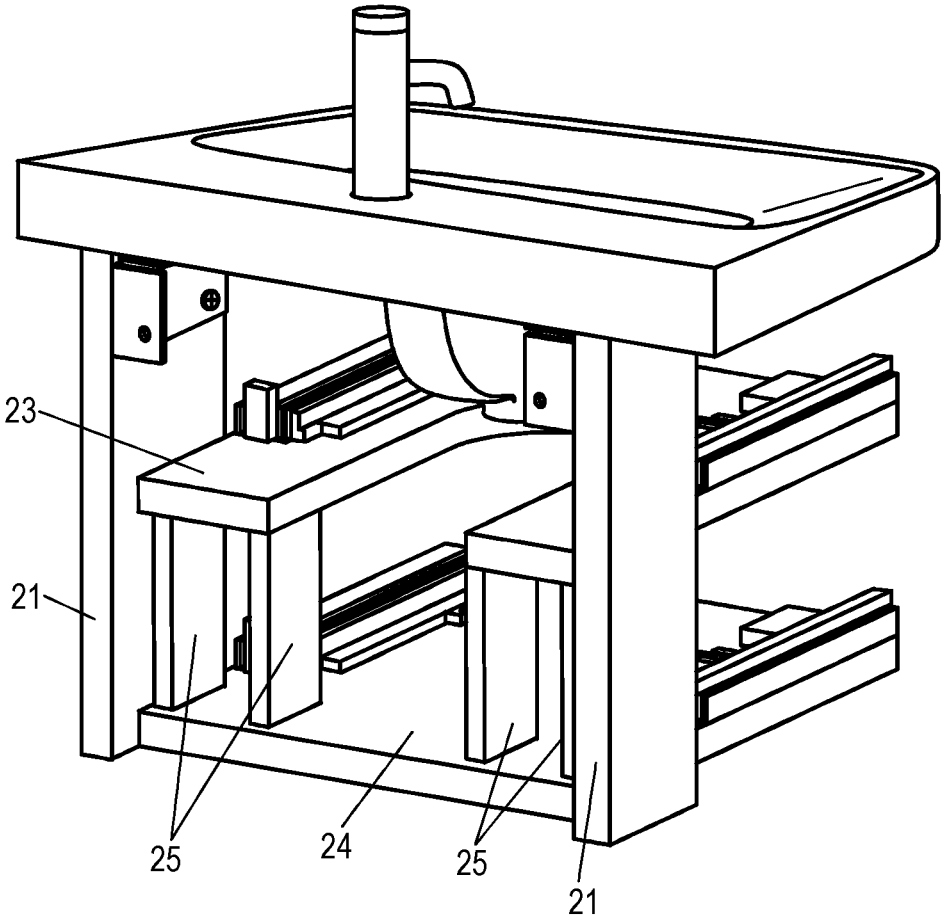
FIG. 7 shows a perspective rear-side view of the arrangement from FIG. 6.
Figure 8:
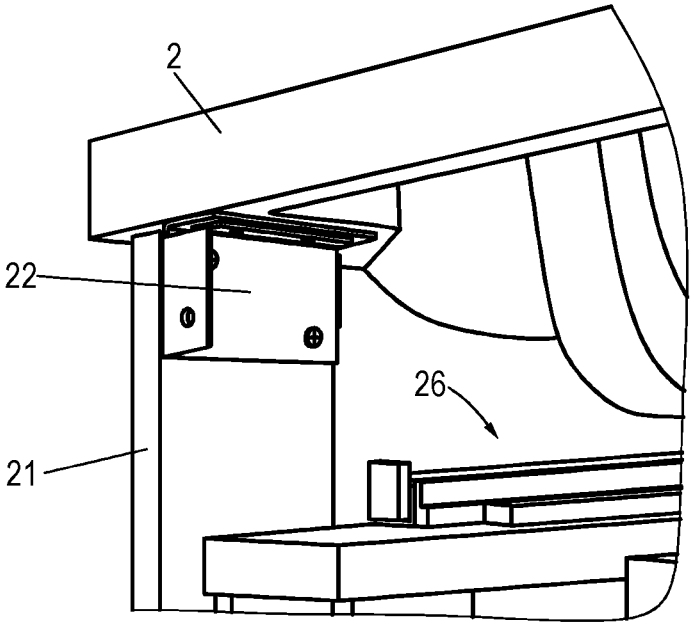
FIG. 8 shows an enlarged partial view of the supporting structure.

FIG. 6 shows a partial view of the sanitary installation 1, wherein the drawers 4, 5 are here not represented in order to show the inner elements of the vanity unit 3 in greater detail. The vanity unit 3 comprises, besides the two drawers 4, 5, a supporting structure 20, to which, on the one hand, the wash basin 2 fastened, and which, on the other hand, in the assembly position, is to be fastened to a wall. The supporting structure 2 comprises two vertical supports 21, to which, on the inner side, see FIG. 8, are fastened appropriate angle supports 22, to which the wash basin 2, as shown by FIG. 8, is fastened, in particular bolted. The wash basin 2 is consequently fastened only to these vertical supports 21, but not to the wall. This fastening is sufficient to appropriately support the wash basin 2.

The supporting structure 20 further comprises two horizontally arranged supports 23, 24, wherein the horizontal support 23 serves to receive and guide the upper drawer 4, and the lower horizontal support 24 serves to receive and guide the lower drawer 5. The horizontal supports 23, 24 are, in turn, fixedly connected to the vertical supports 21. To this end, appropriate supporting beams 25 are provided, which are in part fastened to the vertical supports 21 and to which the appropriate horizontal supports 23, 24 are fastened. Since these are wooden or wood-based structural elements, the fastening is realized via appropriate screwed joints, etc.

As is shown in particular by FIG. 6, on the supports 23, 24 are provided appropriate linear runners 26, 27 which are in the form of undermount runners. Each linear runner has a lower runner part 28, which is fastened to the respective support 23, 24, and an upper runner part 29, which is linearly guided in a movable manner on the lower runner part 28 and which is connected to the bottom side of the base of the respective drawer 4, 5. That is to say that, in the closed position, the linear runners 26, 27 are not visible, as is clearly shown, in particular, by FIGS. 1-3.

The linear runners 26, 27 have an appropriate length which enables the drawers 4, 5 to be pulled out sufficiently far.

Due to the integration of a siphon-like drain 30, via which collecting water flows out of the wash basin 2, the drawer 4 can be provided with an appropriate cutout 31 (see FIG. 4), which encompasses this siphon-like endpiece 30.

As is shown in particular by FIGS. 2 and 3, between the bottom side of the wash basin 2 and the top side of the adjacent drawer 4, and between the bottom side of the drawer 4 and the top side of the drawer 5, respectively a narrow gap 32, 33 is given, which preferably is just a few millimeters wide, for instance within the range between 1 and 5 mm, so that a largely closed exterior is obtained. It is also conceivable, however, to form a larger gap there and to fill this, for instance, by means of an appropriate portion of the vanity unit or of the supporting structure 20, that said portion is virtually visible through the gap or the groove. It is conceivable to give this visible part of the supporting structure 20 a correspondingly different color than the veneer color or paint color, but it can also be veneered in the same color, while the integration of a light strip or the like is also possible.

While specific embodiments of the invention have been shown and described in detail to illustrate the inventive principles, it will be understood that the invention may be embodied otherwise without departing from such principles.

We claim:

1. A sanitary installation, comprising: a ceramic or porcelain wash basin or wash stand and a vanity unit, wherein the vanity unit has at least one pull-out drawer having two side walls and a front wall, wherein the side walls and of the front wall have a shape that conforms to a shape of front and side end faces of the wash basin or wash stand, wherein the end faces are aligned with the side walls and the front wall, and wherein the side walls, the front wall and the end faces are coated with a veneer, applied via an adhesive bond, or with a paint.

2. A sanitary installation according to claim 1, the at least one pull-out drawer including an upper drawer and at least one further drawer beneath the upper drawer, the further drawer having veneer coated side walls and a veneer coated front wall aligned with the side walls and the front wall of the upper drawer.

3. A sanitary installation according to claim 1, wherein the end faces are at a 90° angle to one another, and the side walls and the front wall are at a 90° angle to one another, or they merge one into another via a curvature.

4. A sanitary installation according to claim 1, wherein the veneer extends up to a right-angled top edge of the wash basin.

5. A sanitary installation according to claim 1, wherein the adhesive bond includes an epoxy resin adhesive or a polyurethane adhesive.

6. A sanitary installation according to claim 1, wherein the veneer is a wood veneer, a decorative veneer or a laminated veneer.

7. A sanitary installation according to claim 2, wherein the vanity unit includes a supporting structure beneath the wash basin or wash stand, which supporting structure is fixed on a bottom side of the wash basin or wash stand and/or, in an assembled position, is fixed to a wall and has linear runners on which the at least one drawer runs.

8. A sanitary installation according to claim 7, wherein the supporting structure is configured to be wall-mounted, and the wash basin or wash stand sits on the supporting structure and is fixed to the supporting structure.

9. A sanitary installation according to claim 7, wherein the supporting structure includes a number of horizontally arranged supports corresponding to a number of the at least one drawer, the linear runners, being disposed on the supports.

10. A sanitary installation according to claim 9, wherein the linear runners are undermount runners.

11. A sanitary installation according to claim 7, wherein the end faces are distanced from one another by surfaces of the front and side walls of the upper drawer, and/or the front and side walls of the upper drawer are distanced from those of the further drawer by a gap.

12. A sanitary installation according to claim 11, wherein the supporting structure is configured to form a bottom of the.

* * * * *